United States Patent [19]

Styles et al.

[11] Patent Number: 4,802,508

[45] Date of Patent: Feb. 7, 1989

[54] CYCLICALLY VARYING PULSATING FLUID SUPPLY SYSTEM

[75] Inventors: George R. Styles, Glendale; K. Tom Jones, Chandler; Devin A. Bloom, Phoenix, all of Ariz.

[73] Assignee: Pacific BioSystems, Inc., Phoenix, Ariz.

[21] Appl. No.: 176,361

[22] Filed: Mar. 31, 1988

[51] Int. Cl.[4] ..... B08B 3/02

[52] U.S. Cl. ..... 137/624.13; 137/625.47; 134/199

[58] Field of Search ..... 137/624.13, 624.15, 137/624.18, 624.2, 625.11, 625.47

[56] References Cited

U.S. PATENT DOCUMENTS

| | | | |
|---|---|---|---|
| 2,516,425 | 7/1950 | Sarver | 251/102 |
| 3,050,082 | 2/1962 | Bass et al. | 137/625.11 |
| 3,069,025 | 12/1962 | Winkler | 137/624.13 X |
| 3,096,788 | 7/1963 | Talbot et al. | 137/625.11 |
| 3,098,960 | 7/1963 | Huska | 318/443 |
| 3,111,140 | 11/1963 | Fjermestad | 137/624.13 |
| 3,227,158 | 1/1966 | Mattingly | 128/66 |
| 3,393,673 | 7/1968 | Mattingly | 128/66 |
| 3,508,582 | 4/1970 | Aulisa | 137/625.11 |
| 3,757,806 | 9/1973 | Bhaskar et al. | 134/191 |
| 3,937,252 | 2/1976 | Ishida | 137/624.13 |
| 4,178,963 | 12/1979 | Riefler | 137/625.11 X |
| 4,383,423 | 5/1983 | Lenglet et al. | 62/467 R |
| 4,398,562 | 8/1983 | Saarem et al. | 137/625.47 |
| 4,402,331 | 9/1983 | Taldo et al. | 134/58 R |
| 4,458,708 | 7/1984 | Leonard | 137/625.11 X |
| 4,465,522 | 8/1984 | Taldo et al. | 134/10 |
| 4,649,955 | 3/1987 | Otto et al. | 137/624.13 |

*Primary Examiner*—Alan Cohan

*Attorney, Agent, or Firm*—LaValle D. Ptak

[57] ABSTRACT

A system which is particularly useful for use with lavage hand and arm washing machines supplies pulsating jets of water alternately to a first bank of nozzles (for the right hand) and a second bank of nozzles (for the left hand) without causing on/off shocks to be applied to the water supply system. This is accomplished by supplying the water from the water supply (either from a pump and reservoir or a municipal water supply) to the inlet of a rotating distributor located inside a housing. Outlet pipes for the two banks of nozzles are located on diametrically opposite sides of the housing and communicate with the interior. The distributor is designed to increase the flow through one of the outlets while simultaneously decreasing the flow to the other outlet by a corresponding amount, in a manner which produces a sinusoidal pulsation of the water flow out of each of the banks of nozzles. The flow through the first bank of nozzles, however, is 180° out of synchronism with the flow through the other bank of nozzles; so that the total flow from the source of fluid is essentially constant at all times.

21 Claims, 2 Drawing Sheets

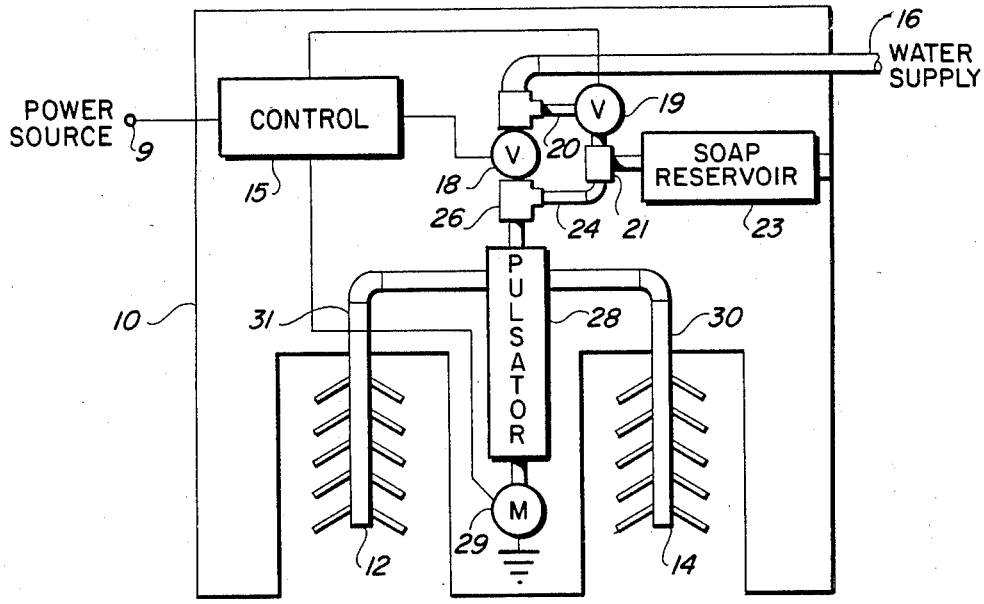
FIG. 1
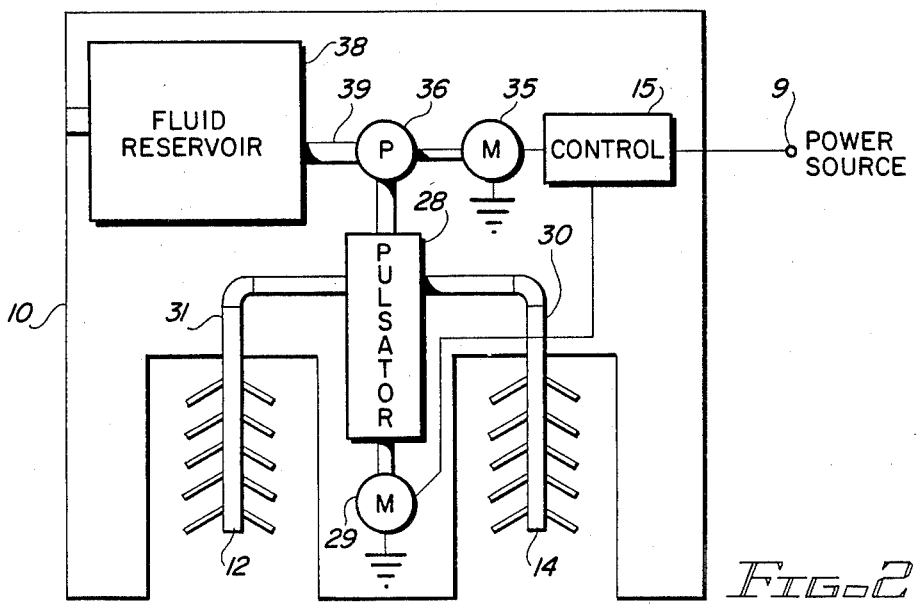
FIG. 2
FIG. 5
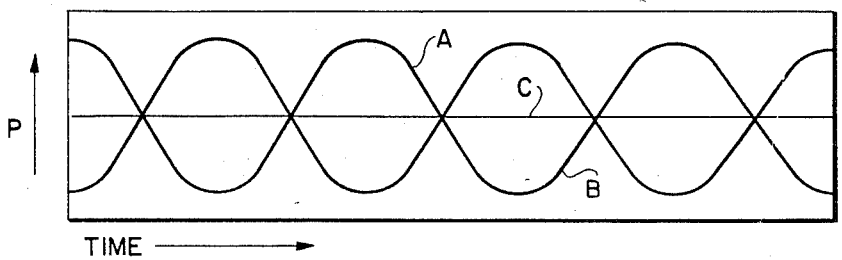

CYCLICALLY VARYING PULSATING FLUID SUPPLY SYSTEM

BACKGROUND

The system of the present invention is particularly useful in conjunction with lavage devices for cleaning the hands and arms of persons such as surgeons, nurses, restaurant workers and the like.

Spray type washing mechanisms are well known. Such mechanisms are used in automatic dishwashers and in other types of spray washing machines to clean various products, such as produce and eggs. Most spray type washing machines employ plurality of jets to direct cleaning fluid, supplied under substantially constant pressure, onto the article being cleaned.

A type of cleaning machine which employs intermittent pulses of pressurized cleaning fluid is disclosed in the Patent to Mattingly U.S. Pat. No. 3,393,673. This patent discloses an oral hygiene appliance with a specialized motor pump to supply a pulsating stream of water from a reservoir to a nozzle. The water is discharged at a relatively high pressure in intermittent slugs or pulses at a rate of approximately 1200 pulses per minute.

Another Mattingly U.S. Pat. No. 3,227,158 also is directed to an oral hygiene apparatus employing a reciprocating pump and plunger arranged in a body of liquid to provide a pulsating jet of water or cleaning fluid within a range of 1000 to 1600 cycles per minute. This patent discloses a variation for bypassing a portion of the liquid supplied by the pump to cause a damping effect to produce a smooth waveform (as contrasted with intermittent). This reduces the shock characteristics of the pulsating jet of water. Both of the Mattingly Patents produce the desired effect by means of a specialized multi-part pump, including a relatively large number of parts. A single delivery nozzle (the tooth cleaning jet) is employed.

In hospitals, it is very important for surgeons, nurses, and other operating room personnel to carefully scrub their hands and forearms to remove bacteria which otherwise may contaminate or infect patients. Under emergency conditions, the survival of a patient frequently depends on the time which elapses while the surgical team scrubs before entering the operating room. A typical pre-surgical scrub requires a time duration of 5 (five) to 15 (fifteen) minutes depending upon the type and length of the planned operation.

The manner in which pre-surgical cleansing of the hands and arms of surgeons and operating room personnel has changed very little since the turn of the century. While improved chemicals and drugs have been discovered over the years, the actual technique for accomplishing pre-surgical cleansing has followed the same pattern for years. Scrub brushes and various chemicals are used to free the hands and forearms from bacteria which may contaminate the patient. The scrubbing is done with a brush and dipping of the hands and forearms into different chemical solutions. The scrubbing must be complete and diligent; and, in many cases, is irrating to the skin. This is particularly true for personnel who must scrub frequently during the day (perhaps as many as twenty to thirty times).

Since not all persons scrub in the same manner, the results achieved vary between persons and between scrubs by the same person. In addition, although diligent scrubbing removes surface bacteria, it has been found to have a lesser effect upon bacteria present in the hair follicles and skin depressions. Obviously, any bacteria not removed may act as a contaminant to the patient during surgery or at other times, for example, as a nurse administers to succession of patients.

Another field, in which the potential for the communication of disease to large numbers of persons is present, is in the food handling industry, particularly in restaurants. In the past, it was thought that simple handwashing with a good soap or detergent was sufficient. It has been found, however, even when such hand washing is diligently undertaken by restaurant workers, the bacteria present on the hands are not removed and a high potential is present for the transfer of this bacteria to the food being served to other persons. This was not much of a concern in the past, but the recent discovery of extremely serious and frequently fatal communicable diseases has created an increased awareness of the necessity for following nearly hospital-like cleanliness procedures in the restaurant and food handling businesses.

In an effort to overcome the disadvantages of the manual, brush and disinfectant scrubbing procedures, an automatic lavage machine for washing the hands and forearms of hospital personnel has been developed and is disclosed in the Patent to Bhaskar U.S. Pat. No. 3,757,806. This patent discloses a pulsating hydrojet lavage device which utilizes pulsating jets of pressurized washing fluid for the purpose of quickly preparing personnel for cleanliness of the hands and forearms. The hands and arms of the individual to be scrubbed are inserted into a washing chamber which has a manifold arranged in it to subject the arms and hands to pulsating jets of washing fluid discharged from the manifold. The device of this patent is operated at a pulse frequency of approximately 1500 pulses per minute; and the spray jets of fluid from the manifold cause a compression/-decompression effect on the skin, which is particularly effective in removing dirt and bacteria from the hair follicles and skin folds. The device of this patent is operated at a pressure range of approximately 20 PSI to 80 PSI. In a relatively short period of time, approximately twenty (20) to ninety (90) seconds, the resulting cleanliness is equal to or better than a conventional surgical scrub of five (5) minutes or more duration. Although the device of this patent is effective in cleansing the skin, the rapid turning on and off of the cleaning fluid produces considerable shock to the system and results in an extremely loud noise factor. In addition, the high speed pulsating on/off fluid jets, while being an effective cleanser of the skin, also are irrating to the skin, since these high pressure pulses have the effect of "slapping" the skin.

In an effort to overcome some of the disadvantages of the Bhaskar Patent, a lavage machine which produces a cyclically varying pressure has been developed. This machine and its method of operation are disclosed in the Patents to Taldo U.S. Pat. No. 4,402,331 and U.S. Pat. No. 4,465,522. These patents disclose a portable lavage machine which has a recirculating pump in it for withdrawing fluid from a reservoir and supplying it to a cleaning jet manifold. The fluid supplied from the pump first is supplied to a delivery chamber. This chamber has a pair of motor driven impellers in it which rotate past a pair of output orifices to cause cyclical changes in pressure of the fluid delivered from the chamber to the output orifices. The orifices, in turn, are connected to supply fluid to the cleaning jet manifolds in the machine. A motor to rotates the impellers, and the speed of rotation is selected to cause pressure changes from a maximum to a minimum approximately 1200 times per minute.

The shape of the impellers of Taldo is selected to cause the pressure to vary from a minimum (not zero) pressure to some maximum pressure with the transition between the pressure changes being gradual between the two pressure limits. The maximum pressure is maintained for a greater length of time than the minimum pressure, with a gradual, but fairly rapid transition between the pressure changes; so that the resultant pressure waveform is a modified rectangular waveform of an unequal duty cycle. The impeller mechanism significantly reduces the mechanical "banging" of the fluid, as contrasted with the device of Bhaskar. Because of the uneven duty cycles, however, even when two output orifices are provided with the impellers operating 90° out of phase with one another, significant pressure changes are effected at the supply side or input side of the impeller chamber. These pressure changes produce additional stresses on the pump supplying the cleaning fluid to the device as well as creating vibrational stresses on the various parts of the machine.

Other devices have been developed for producing pulsating fluid outputs from a fluid supply. Four such patents are the Patent to Fjermestad U.S. Pat. Nos. 3,111,140; Ishida 3,937,252; Lenglet 4,383,423; and Otto 4,649,955. All four of these patents disclose valve structures to produce pulsed outputs, but none of the valves disclosed in these patents maintain a constant load or constant pressure on the input supply to the devices.

Rotary valves also are well known for directing a fluid path from one or more inputs to a single output or from a single input to selected ones of various outputs. This generally is accomplished by means of an internal rotating part, having a non-linear channel through it, for interconnecting a line located axially with the rotating part to various lines located in different radial positions in a housing. Patents disclosing this type of device are the Patents to Sarver U.S. Pat. No. 2,516,425 and Bass U.S. Pat. No. 3,050,082.

It is desirable to provide a fluid delivery system which is particularly useful in conjunction with lavage machines which does not have the disadvantages of the prior art mentioned above and which delivers a cyclically varying pulsating supply of fluid to the delivery manifolds of the lavage machine, while maintaining a substantially constant pressure on the input line which supplies fluid to the machine.

SUMMARY OF THE INVENTION

Accordingly, it is an object of this invention to provide an improved fluid delivery system.

It is another object of this invention to provide an improved pulsating fluid delivery system.

It is an additional object of this invention to provide an improved fluid delivery system for delivering fluid with a cyclically varying pressure to a utilization device while maintaining the pressure on the fluid supply to the system at a substantially constant level.

It is a further object of this invention to provide an improved fluid delivery system for a lavage machine.

In accordance with the preferred embodiment of this invention, a system for delivering a pulsating supply of fluid to a pair of utilization devices includes a source of fluid at a predetermined pressure. The first and second utilization devices have respective first and second inlets for receiving fluid. A pulsator has an inlet coupled with the source of fluid and has first and second outlets coupled with the first and second inlets, respectively, of the first and second utilization devices. The pulsator includes means for apportioning the fluid supplied to it in a cyclically varying pattern of pressure to each of the first and second outlets, such that the total fluid flow through both of the first and second outlets remains substantially constant. The pressure of the fluid at the input to the pulsator also remains substantially constant at the predetermined pressure.

BRIEF DESCRIPTION OF THE DRAWINGS

FIG. 1 is a diagramatic representation of a preferred embodiment of the invention;

FIG. 2 is a diagramatic representation of another preferred embodiment of the invention;

FIG. 5 is a waveform representation useful in explaining the operation of the device shown in FIGS. 3 and 4.

DETAILED DESCRIPTION

Figure 3:
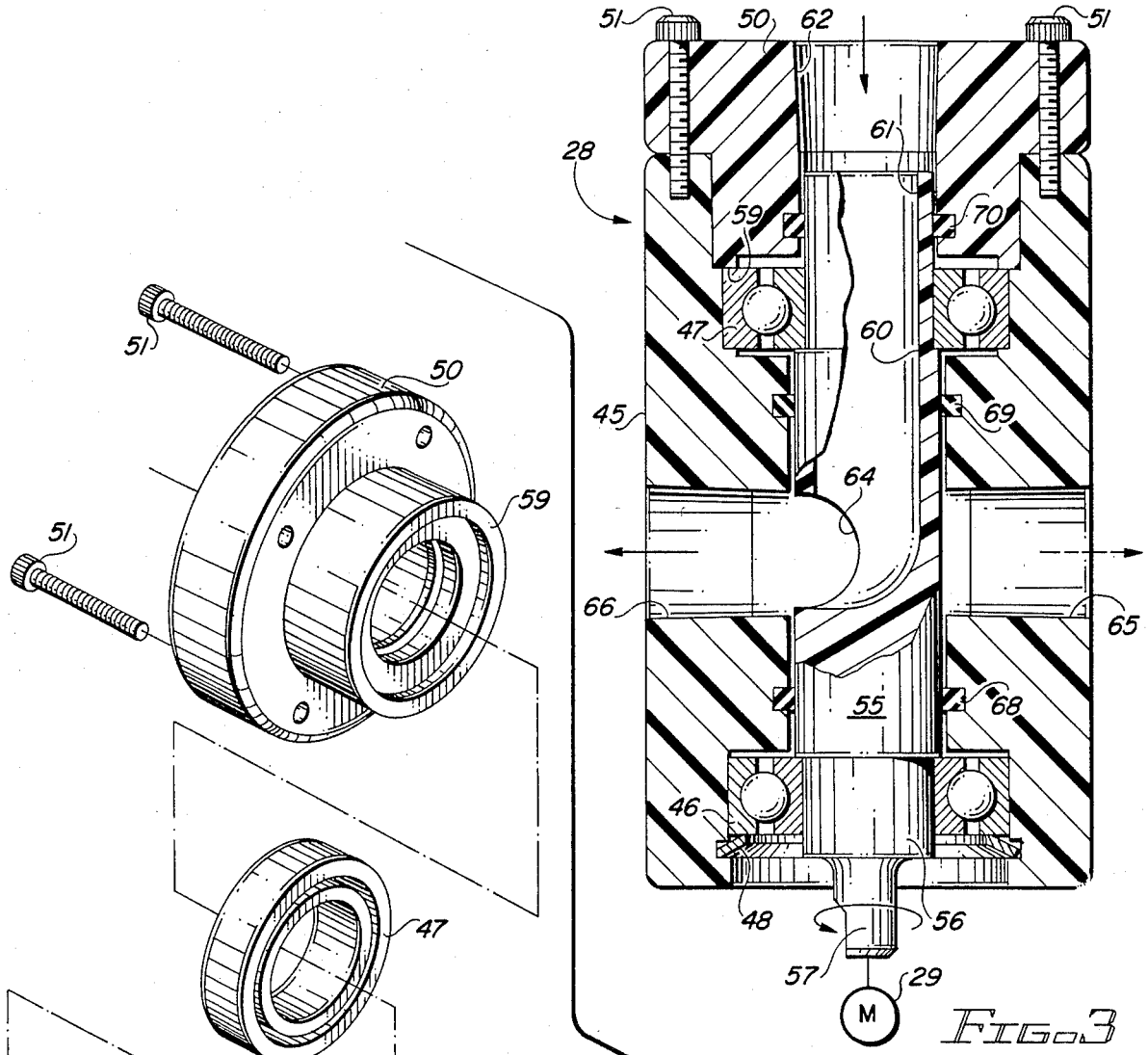
FIG. 3 is a cross-sectional view of a pulsator in accordance with the preferred embodiments of the invention.

Reference now should be made to he drawings in which the same reference numbers are used throughout the different figures to designate the same components. FIG. 1 is a diagramatic representation of a lavage machine 10 which may be of the type disclosed in the above-mentioned Taldo Patents U.S. Pat. No. 4,402,331 and U.S. Pat. No. 4,465,522. Since the actual construction of the lavage machine itself can be of any known type, details of that construction have not been shown in the embodiment of FIG. 1.

The lavage machine 10 includes a pair of spray nozzle manifolds 12 and 14 for washing the left and right hands, respectively, of a user. These manifolds may be of any desired type, including those of the Taldo Patents. In the embodiment of FIG. 1, the water for the lavage machine 10 is obtained from a standard municipal water supply line 16 (preferably after being heated in a water heater). Normally water from the supply line 16 is prevented from being applied to the manifolds 12 and 14 by closed electric valves 18 and 19.

When the machine of FIG. 1 is to be used, a control system 15, supplied with suitable operating power from a source 9 (not shown), is operated to open both of the valves 18 and 19. Some of the water from the supply 16 passes directly through the valve 18, and through a conventional plumbing "Tee" 26, to a pulsator 28. Water also is supplied from the line 16 through the valve 19 over a line 20 into a venturi "Tee" 21 connected to a liquid soap reservoir 23. The water passing through the venturi 21 withdraws a predetermined amount of soap from the reservoir 23. This soap is mixed with the water and is provided through a pipe 24 to the "Tee" 26. There it is mixed with the water flowing through the valve 18 from the water supply, and this mixture is supplied as a combination water/soap mixture to the pulsator 28.

The pulsator 28 is used to provide cyclically varying pulses of water, 180° out of phase, through outlet pipes 31 and 30, respectively, to the spray manifolds 12 and 14 in the lavage machine. Operation of the pulsator 28 to effect this function is provided by a motor 29, which is turned on by the control system 15 at the time the valves 18 and 19 are opened. A drain (not shown) removes the spent fluid from the machine. At the end of a lavage cycle, the control system 15 closes the valves 18 and 19 and turns off the motor 29. The system then remains in this standby state until the next time it is to be used.

FIG. 2 illustrates an alternative embodiment which is similar to the one of FIG. 1, but which uses recirculating cleaning fluid from a reservoir 38 instead of water supplied from a water supply line 16. The recirculating system of FIG. 2 is similar in its general operating characteristics to the recirculating systems disclosed in the two above-identified Taldo Patents. The fluid reservoir 38 includes a premixed cleansing fluid/water combination, so that a separate soap reservoir of the type shown in the embodiment of FIG. 1 is not necessary. Since a water supply under a pre-established line pressure also is not available, fluid from the reservoir 38 is supplied over a pipe 39 to a pump 36, which preferably is of the type employing a continuously rotating impeller, for delivering fluid flow at a constant rate and a constant pressure when it is operated.

In the standby condition of operation, the pump 36 is turned off; so that no fluid flows from the reservoir 38 through the pipe 39. When operation of the lavage machine 10 of FIG. 2 is desired, the control system 15 provides operating signals to the motor 29 which operates the pulsator 28 and to a second motor 35 for rotating the pump 36. In all other respects, the device of FIG. 2 operates in the same manner as the embodiment shown in FIG. 1.

Figure 4:
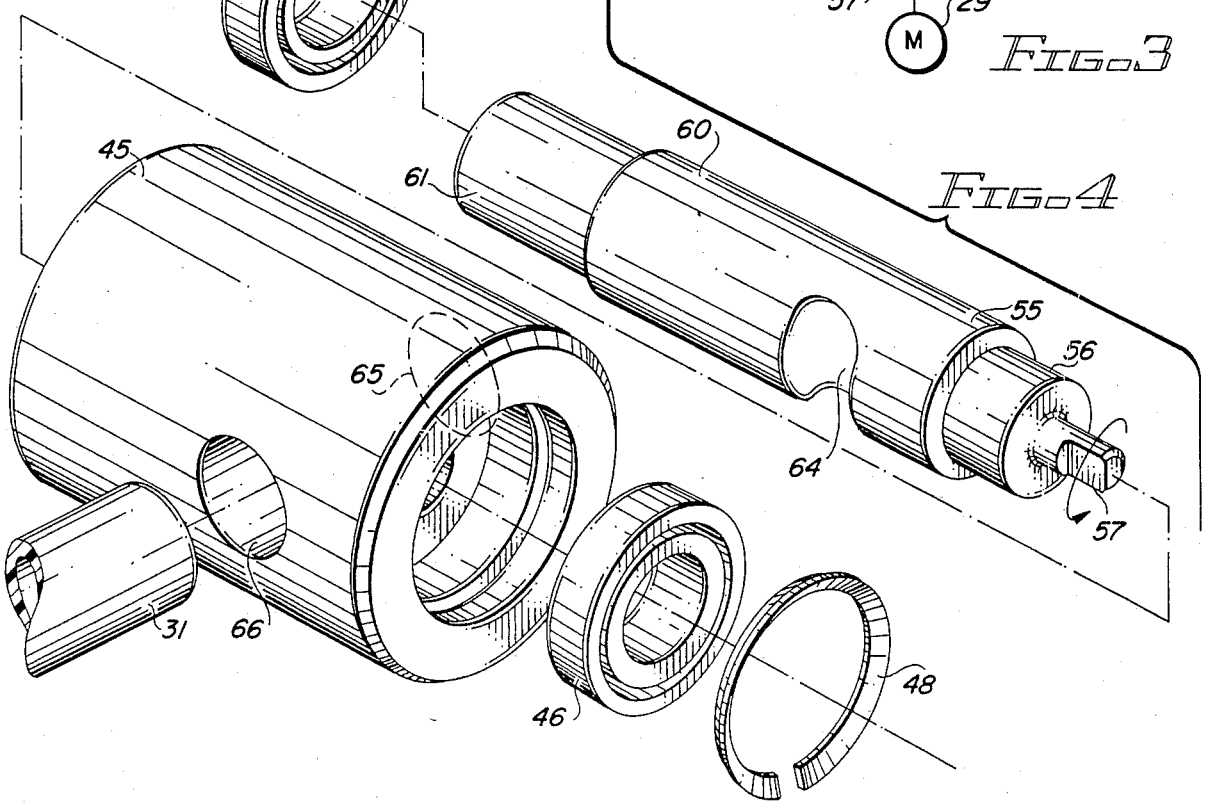
FIG. 4 is an exploded view of the device shown in FIG. 3.

Reference now should be made to FIGS. 3 and 4, which illustrate the details of the pulsator 28 shown in FIGS. 1 and 2. The pulsator 28 has an external hollow cylindrical housing 45 with a reduced diameter central portion opening into larger diameter open end portions. A pair of bearings 46 and 47 abut the shoulders between the portion of the housing 45 and the larger internal diameter end portions. The bearing 46 is held in place by a lock washer 48, and the bearing 47 is held in place by means of an end cap 50, bolted into the upper end of the housing 45 by means of a series of bolts 51 located about the periphery.

The inner races of the bearings 46 and 47 engage reduced diameter sections 56 and 61 of a rotating fluid distributor which has a solid lower portion 55 and a hollow upper portion 60 (as illustrated most clearly in FIG. 3). The upper portion 60 has an opening through its interior which communicates with an opening 62 in the end cap 50 for connection to the fluid input pipe at the output of the pump 36 (FIG. 2) or the "Tee" 26 of the device shown in FIG. 1. The lower end of the distributor includes a shaft 57. This shaft is connected in any suitable manner to the drive motor 29, which rotates the distributor 55/56, 60/61 of the pulsator 28 at approximately 1000 to 1500 revolutions per minute.

As illustrated in FIGS. 3 and 4, the hollow interior portion 60 of the rotating distributor opens into an elongated slot 64, which is cut through approximately 50% of the external diameter of the distributor. This slot 64 has a width which is equal to the diameter of a pair of circular outlets 65 and 66 located on the right hand and left hand sides, respectively, of the pulsator 28 device. These outlets 65 and 66, in turn, are connected to the pipes 30 and 31 for supplying fluid to the manifolds 14 and 12, respectively, of the lavage machine (FIGS. 1 and 2).

As mentioned above in conjunction with the operation of the device shown in FIGS. 1 and 2, when the motor 29 is turned on, it rotates the distributor of the pulsator 28 to cause the fluid flowing through the portion 60 from the inlet 62 in the outer housing to be supplied in varying amounts to the outlets 65 and 66. In the position shown in FIG. 3, a maximum amount of fluid is supplied to the outlet 66, while a minimum amount of fluid is supplied to the outlet 65. This minimum amount is determined by the space between the outside diameter of the distributor portion 55/60 and the inner diameter of the housing 45. A fluid tight chamber is formed in this space between a pair of sealing rings 68 and 69, as illustrated in FIG. 3. Another fluid sealing ring 70 is placed in the cap 50, between the cap and the outer diameter of the portion 60, to prevent water leakage from taking place from the inlet 62 into the bearing 47.

Reference should be made to FIG. 5, taken in conjunction with the operation of the device shown in FIGS. 3 and 4. FIG. 5 illustrates the varying fluid pressures which occur during the continuous operation of the device of FIGS. 3 and 4, as the distributor 55/56, 60/61 of the pulsator 28 is rotated by the motor 29. Waveform C represents the pressure (and fluid flow) of the fluid supplied to the inlet 62 from either the pump 36 (FIG. 2) or the plumbing "Tee" 26 (FIG. 1). Waveform A represents the fluid flow through the outlet 65 (and into pipe 30 for the manifold 14), and waveform B of FIG. 5 represents the fluid flow from the outlet 66 (and into the pipe 31 for the manifold 12).

The size of the slot 64 is selected such that when the shaft 57 is rotated 90° from the position shown in FIG. 3, opposite edges of the slot 64 open one-half of the area of each of the outlets 65 and 66 to supply equal amounts of fluid to both of the outlets. This condition is illustrated at the points where waveforms A, B and C cross one another at various points shown in FIG. 5.

Continued rotation of the shaft 57 by the motor 29 in the direction of the arrow then reduces the amount of fluid flowing into the outlet 66 and increases the amount flowing into the outlet 65 by exactly the same amount. At all times, the total amount of fluid flowing into both of the outlets 65 and 66 is the same and equals the fluid flow/pressure at the inlet 62. This is illustrated in waveform C of FIG. 5. At the same time the fluid flow/pressure flowing into the outlets 65 and 66 (and therefore the manifolds 14 and 12) varies in a sinusoidal pattern, 180° out of phase with one another, as illustrated by the waveforms A and B in FIG. 5. This results in a cyclically varying pulsating change in the pressure of the fluid flowing from the jets in the manifolds 12 and 14. This pressure change is a uniform, smooth pressure change in both manifolds which varies cyclically from a minimum pressure, as illustrated in FIG. 5, to a maximum pressure and back to a point of minimum pressure. No sharp on/off pulsating transitions occur. As a consequence, irritation to the hands and arms of a user of the machine is substantially reduced.

A uniform fluid flow also constantly takes place, insofar as the supply to the inlet 62/61 is concerned, so that stress on the pump or water supply system is signficantly minimized and no fluid "banging" of the plumbing in the system occurs. Because of the balance and symmetrical operation of the pulsator 28, an essentially vibration free operation occurs, with a very smooth continuous flow of fluid constantly occuring throughout the operation of the system.

The foregoing description and the embodiments shown in the drawings should be considered as illustrative rather than as limiting of the invention. The representations of the lavage machine clearly are intended to be illustrative only, and a wide variety of different types of manifolds may be employed in accordance with the desires of the end users of the machines. The particular bearings and specific constructional details of the pulsator 28 which have been illustrated, also are representative of the invention and may be modified by those skilled in the art, if desired. The true scope of the invention is defined by the appended claims.

I claim:

1. A system for delivering a pulsating supply of fluid to a utilization device, including in combination:

a source of fluid at a predetermined pressure;

at least first and second utilization devices for receiving fluid on first and second inlets, respectively; and pulsator means having an inlet coupled with said source of fluid and having at least first and second outlets coupled, respectively, to said first and second inlets of said first and second utilization devices, said pulsator means apportioning fluid in a cyclically varying pattern of pressure from the inlet thereof to each of the first and second outlets thereof such that the total fluid flow through both of said first and second outlets thereof remains substantially constant, and the pressure of fluid at the input to said pulsator means remains substantially constant at said predetermined pressure, while the cyclical flow of fluid through said first outlet increases with a corresponding decrease of the flow of fluid through the second outlet thereof and vice-versa.

2. The combination according to claim 1 wherein said pulsator means is constructed to cause a substantially sinusoidal varying pattern of pressure and flow of fluid through said first and second outlets.

3. The combination according to claim 2 wherein said pulsator means has a hollow external cylindrical housing, with said first and second outlets located therein on opposite sides thereof; an internal rotating distributor, having a fluid inlet coupled to said source of fluid and having an outlet therefrom for apportioning fluid from the inlet thereof in said cyclically varying pattern to said first and second outlets in said external housing; and means for rotating said distributor.

4. The combination according to claim 3 wherein said rotating distributor comprises a second elongated cyclindrical member mounted coaxially with the central axis of said external housing for rotation therein, with the sizes of said first and second outlets in said external housing and the outlet of said distributor (interconnected in fluid flow relationship with the inlet thereof) apportioned to provide a maximum flow to the first outlet in said housing and minimum flow to the second outlet in said housing in a first rotational position of said distributor, with a decrease in flow through the first outlet of said housing and a directly corresponding increase in flow through the second outlet of said housing as said distributor rotates to a position 180° from said first position, whereupon maximum flow is provided through the second outlet of said housing and minimum flow through the first outlet of said housing, whereupon continued rotation of said distributor causes corresponding decreased flow through said second outlet and increased flow through said first outlet of said housing until said distributor has rotated 360°, such pattern repeating continuously as said distributor is continuously rotated.

5. The combination according to claim 4 wherein said means for rotating said distributor is an electric motor.

6. The combination according to claim 5 further including bearing means for mounting said distributor for rotation within said housing; and means for preventing fluid from flowing out of said housing past said distributor.

7. The combination according to claim 6 wherein said distributor is at least partially hollow from the end adjacent the inlet thereof to a point adjacent said first and second outlets in said external housing, with a transverse elongated slot through said distributor at said point adjacent said first and second outlets in said housing for supplying fluid therefrom to said first and second outlets.

8. The combination according to claim 7 wherein said first and second outlets in said housing are circular in cross-section.

9. The combination according to claim 8 wherein said first and second outlets in said housing each have substantially the same diameter, and the width of said slot is substantially equal to the diameter of said outlets.

10. The combination according to claim 9 wherein said source of fluid comprises a pump withdrawing fluid from a reservoir.

11. The combination according to claim 9 wherein said source of fluid is a water supply line for a building.

12. The combination according to claim 1 wherein said pulsator means has a hollow external cylindrical housing, with said first and second outlets located therein on opposite sides thereof; an internal rotating distributor, having a fluid inlet coupled to said source of fluid and having an outlet therefrom for apportioning fluid from the inlet thereof in said cyclically varying pattern to said first and second outlets in said external housing; and means for rotating said distributor.

13. The combination according to claim 12 wherein said means for rotating said distributor is an electric motor.

14. The combination according to claim 13 wherein said source of fluid comprises a pump withdrawing fluid from a reservoir.

15. The combination according to claim 13 wherein said source of fluid is a water supply line for a building.

16. The combination according to claim 12 wherein said pulsator means is constructed to cause a substantially sinusoidal varying pattern of pressure and flow of fluid through said first and second outlets.

17. The combination according to claim 16 wherein said distributor is at least partially hollow from the end adjacent the inlet thereof to a point adjacent said first and second outlets in said external housing, with a transverse elongated slot through said distributor at said point adjacent said first and second outlets in said housing for supplying fluid therefrom to said first and second outlets.

18. The combination according to claim 17 wherein said first and second outlets in said housing are circular in cross-section.

19. The combination according to claim 18 wherein said first and second outlets in said housing each have substantially the same diameter, and the width of said slot is substantially equal to the diameter of said outlets.

20. The combination according to claim 1 wherein said source of fluid comprises a pump withdrawing fluid from a reservoir.

21. The combination according to claim 1 wherein said source of fluid is a water supply line for a building.

* * * * *